US008547292B2

(12) United States Patent
Wu et al.

(10) Patent No.: US 8,547,292 B2
(45) Date of Patent: Oct. 1, 2013

(54) COMMUNICATION DEVICE WITH EMBEDDED ANTENNA

(75) Inventors: Min-Chung Wu, Taoyuan County (TW); Shao-Chin Lo, Miaoli (TW)

(73) Assignee: Ralink Technology Corp., Jhubei, Hsinchu County (TW)

( * ) Notice: Subject to any disclaimer, the term of this patent is extended or adjusted under 35 U.S.C. 154(b) by 457 days.

(21) Appl. No.: 12/895,795

(22) Filed: Sep. 30, 2010

(65) Prior Publication Data

US 2011/0095963 A1 Apr. 28, 2011

(30) Foreign Application Priority Data

Oct. 22, 2009 (TW) ..... 98135751 A

(51) Int. Cl.
*H01Q 1/50* (2006.01)
*H01Q 1/24* (2006.01)

(52) U.S. Cl.
USPC ..... 343/906; 343/702

(58) Field of Classification Search
None
See application file for complete search history.

(56) References Cited

U.S. PATENT DOCUMENTS

| | | | | |
|---|---|---|---|---|
| 4,940,992 | A * | 7/1990 | Nguyen et al. | 343/803 |
| 5,113,196 | A * | 5/1992 | Ponce de Leon et al. | 343/744 |
| 5,148,181 | A * | 9/1992 | Yokoyama et al. | 343/702 |
| 6,917,334 | B2 * | 7/2005 | Chen | 343/700 MS |
| 6,963,309 | B2 * | 11/2005 | Andersson et al. | 343/702 |
| 7,274,340 | B2 * | 9/2007 | Ozden et al. | 343/860 |
| 7,675,470 | B2 * | 3/2010 | Sanz et al. | 343/702 |
| 2011/0043408 | A1 * | 2/2011 | Shi et al. | 343/700 MS |

FOREIGN PATENT DOCUMENTS

| | | | |
|---|---|---|---|
| CN | 1797844 | A | 7/2006 |
| CN | 201060951 | Y | 5/2008 |
| CN | 101276960 | A | 10/2008 |

* cited by examiner

*Primary Examiner* — Trinh Dinh
(74) *Attorney, Agent, or Firm* — Winston Hsu; Scott Margo

(57) ABSTRACT

A communication device with an embedded antenna includes a printed circuit board and an embedded antenna including at least one radiating unit, at least one feeding unit, where each feeding unit is coupled to a corresponding one of the at least one radiating unit and the printed circuit board, and a connecting unit coupled to the at least one radiating unit including a first connecting portion and a second connecting portion. The connecting unit and the at least one radiating unit form a loop structure such that the embedded antenna is capable of covering one side of the printed circuit board.

11 Claims, 7 Drawing Sheets

COMMUNICATION DEVICE WITH EMBEDDED ANTENNA

CROSS REFERENCE TO RELATED APPLICATIONS

This application claims priority under 35 U.S.C. 119 from TAIWAN Application No. 098135751 filed on Oct. 22, 2009, the contents of which are incorporated herein.

BACKGROUND OF THE INVENTION

1. Field of the Invention

The present invention relates to a communication device with an embedded antenna, and more particularly, to a communication device with an embedded antenna capable of covering a printed circuit board of the communication device and going through the surface mount technology procedure with the printed circuit board.

2. Description of the Prior Art

Wireless communication network is a dominant channel for communication and data transmission in modern society. Wireless communication devices, such as cell-phones, PDAs, and wireless USB dongles, have become more and more popular and are developed toward minimization. Also, the manufacture process of the wireless communication device is simplified to decrease the cost and enhance the productivity. In the composition of a wireless communication device, besides a printed circuit board, an antenna is another unit with larger volume, in which field an embedded antenna formed by metal plates have become one of the mainstream, to facilitate the flexibility of appearance of the wireless communication device and meet the need for portability at the same time.

Electronic units connect to the printed circuit board through the automatic surface mount technology procedure. However, the embedded antenna of the prior art is not a surface mounted unit, and hence cannot be assembled through the surface mount technology procedure, but through an additional assembling process instead. There are two assembling methods of the embedded antenna of the prior art. One is manually welding the antenna onto the printed circuit board after the surface mount technology procedure is performed to the printed circuit board; the other is installing the antenna on the shell of the wireless communication device such that the antenna contacting the contact spring on the printed circuit board. The above two assembling methods of the embedded antenna cost more, and the manual assembling process easily causes instability of antenna characteristics. In addition, the total height of wireless communication devices formed according to the above assembling methods are roughly determined by the height of printed circuit board plus the height of embedded antenna, hence only limited amount of height can be saved.

From the above, the embedded antenna according to the prior art needs additional assembling process, and thereof results in an increase of the production cost of the wireless communication device. It must be improved to reach the goal of minimization and high productivity.

SUMMARY OF THE INVENTION

It is therefore a primary objective of the claimed invention to provide a communication device with an embedded antenna.

The present invention discloses a communication device with an embedded antenna comprising a printed circuit board and an embedded antenna, which comprises at least one radiating unit, at least one feeding unit, wherein each feeding unit is coupled to one of the at least one radiating unit and the printed circuit board, and a connecting unit, coupled to the at least one radiating unit, comprising a first connecting portion and a second connecting portion. The connecting unit and the at least one radiating unit form a loop structure such that the embedded antenna is capable of covering one side of the printed circuit board.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
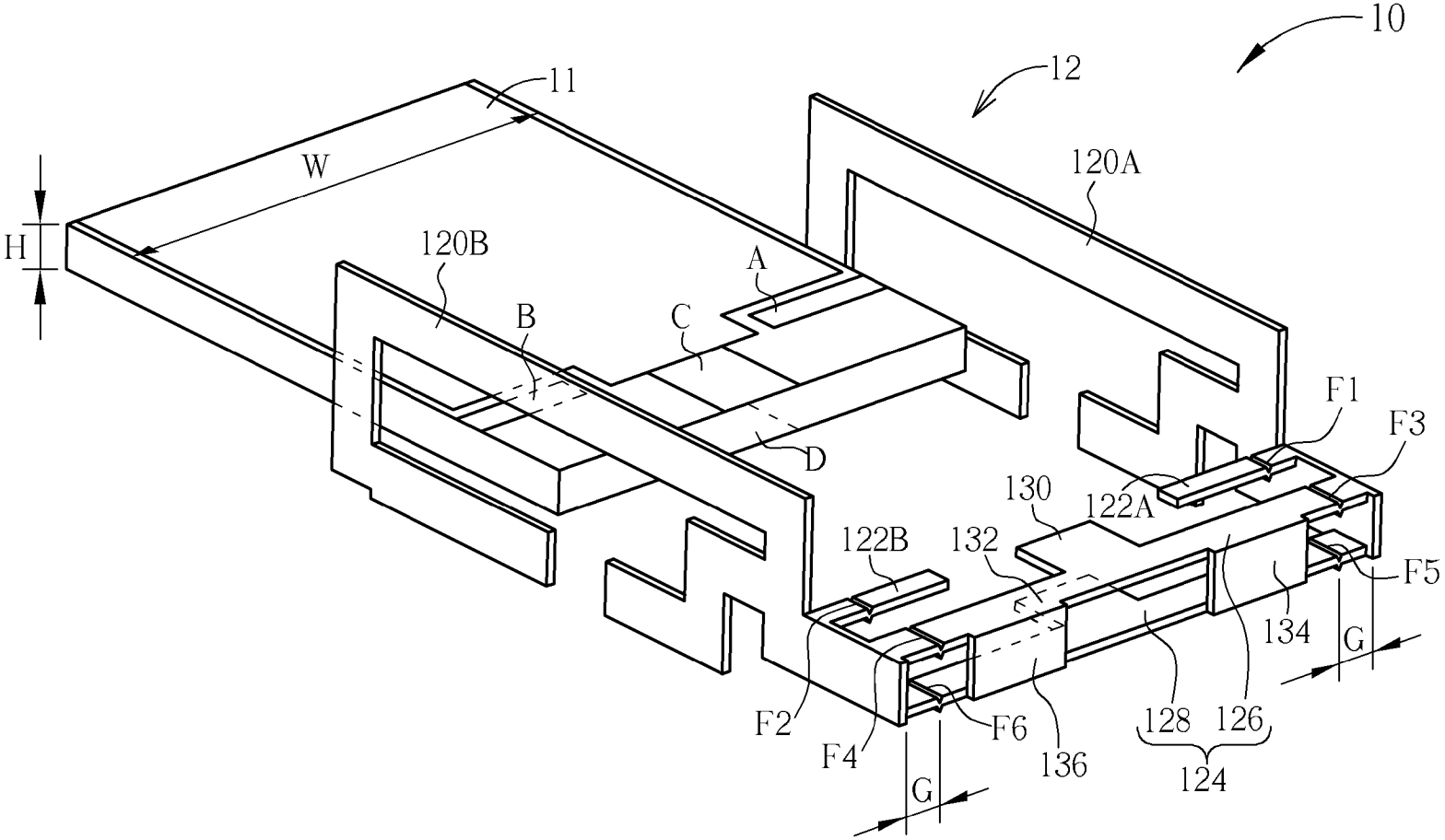
FIG. 1 is a schematic diagram of a communication device according to an embodiment of the present invention.

Please refer to FIG. 1. FIG. 1 is a schematic diagram of a communication device 10 according to an embodiment of the present invention. The communication device 10 can be a cell-phone, a PDA, or a wireless USB dongle, and comprises a printed circuit board 11 and an embedded antenna 12. The printed circuit board 11 is used to realize the functionalities of the communication device 10, which may comprise a radio frequency (RF) circuit, a modulation/demodulation circuit, etc., according to system requirements. The embedded antenna 12 is an antenna compatible of the 2T2R system, by which the communication device 10 realizes the application of two transmitters and two receivers. In addition, in FIG. 1, the printed circuit board 11 and the embedded antenna 12 are not yet combined. It can be referred to FIG. 2A, FIG. 2B, and FIG. 3 for detailed descriptions.

Figure 2B:
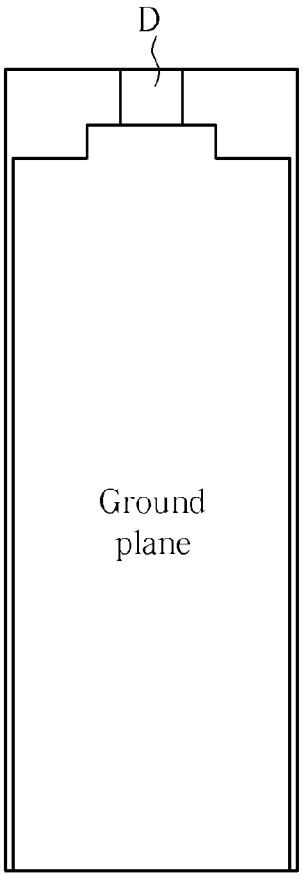
FIGS. 2A and 2B are a top view and a bottom view of printed circuit board of a communication device according to an embodiment of the present invention.
Figure 2A:
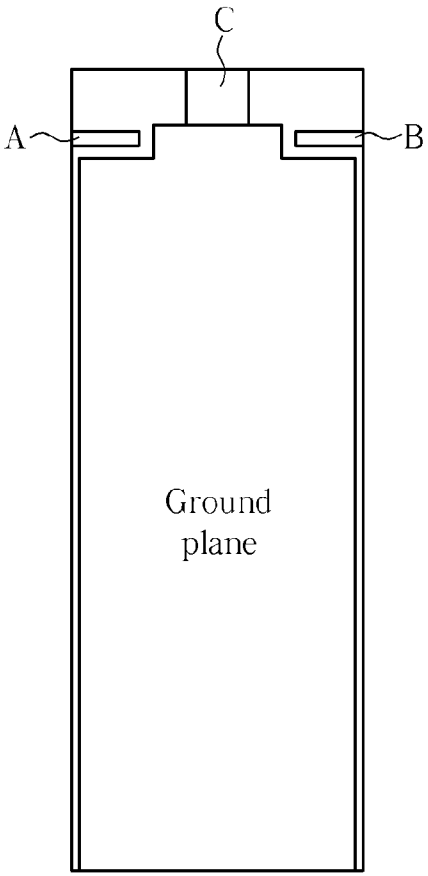
Figure 3:
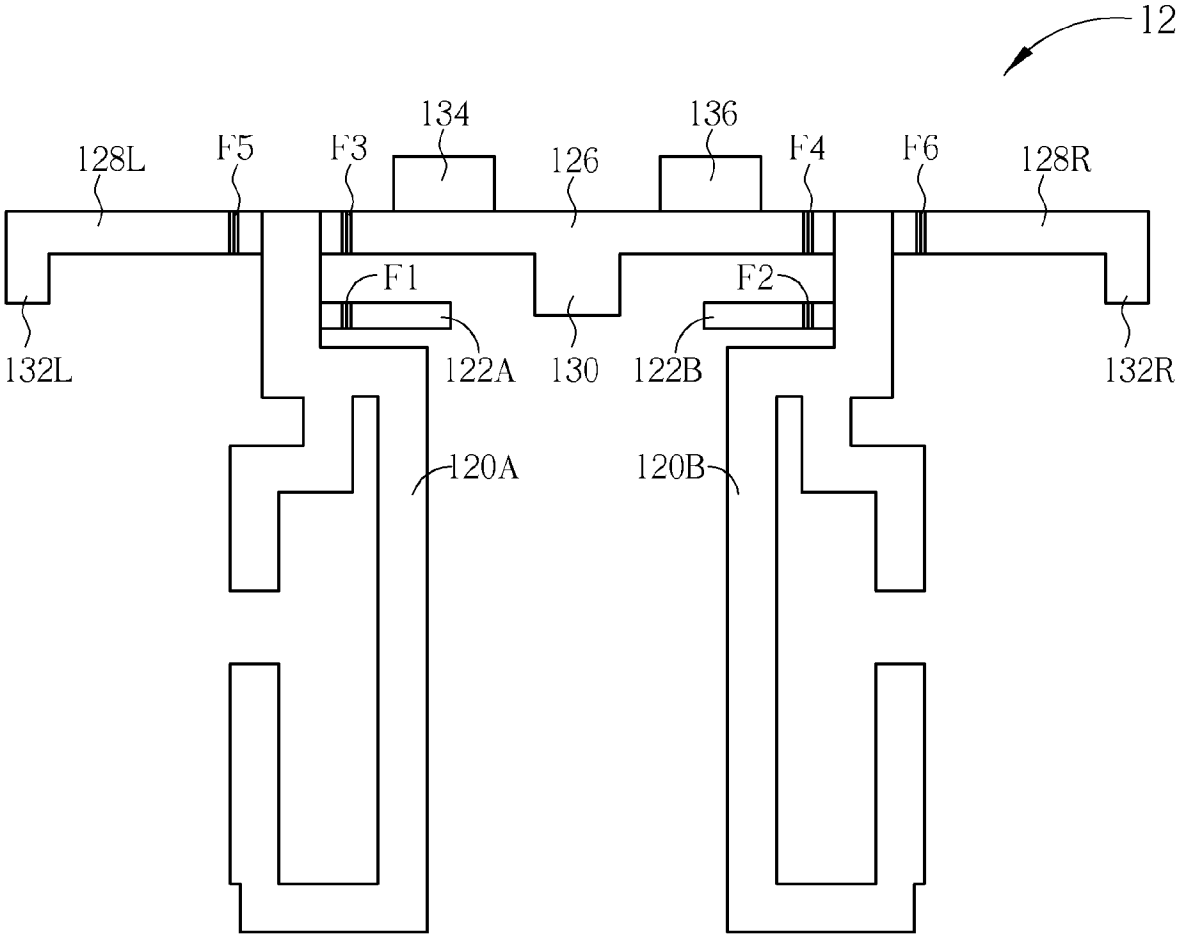
FIG. 3 is a plan expanded view of an embedded antenna according to an embodiment of the present invention.

First, FIGS. 2A and 2B are the top view and the bottom view of printed circuit board 11 of FIG. 1 respectively. The top layer and the bottom layer of the printed circuit board 11 are the placing areas of electronic units of communication device 10, while a ground plane located in one of multiple layers of the printed circuit board 11. On one side of the top layer and the bottom layer of the printed circuit board 11 metal areas A-D are placed, marked by oblique lines. The metal areas A-D are copper exposure areas, not covered with insulating paint in the manufacture process of printed circuit board 11, wherein the metal areas A and B are the feeding points of signals. The metal areas C and D are located in the top layer and the bottom layer of the printed circuit board 11 respectively, and the metal areas A and B are located in the same layer with the metal area C. Next, please refer to FIG. 1 and FIG. 3 at the same time. FIG. 3 is a plan expanded view of the embedded antenna 12. The embedded antenna 12 is the combination of two planner inverted-F antennas (PIFA), formed by metal plates, which comprise radiating units 120A and 120B, feeding units 122A and 122B, a connecting unit 124, fixing units 130 and 132, and blocking units 134 and 136.

The radiating unit 120A and 120B are utilized for radiating the RF signals generated from the circuits on printed circuit board 11 to air, and receiving RF signals of different frequencies from air. The radiating unit 120A is apart from the radiating unit 120B by more than a distance w, the length of one side of printed circuit board 11. Please note that the shape of both radiating unit 120A and 120B shown in FIG. 1 is merely an embodiment of the present invention, the present invention is not limited to the shape of both radiating units 120A and 120B. The feeding unit 122A is coupled to the radiating unit 120A, and comprises a blocking portion F1; the feeding unit 122B is coupled to the radiating unit 120B, and comprises a blocking portion F2; the blocking portion F1 and the blocking portion F2 are fillisters formed through the pressing in the manufacture process of the embedded antenna 12. The feeding unit 122A and the feeding unit 122B are used for feeding the RF signals generated from circuits on the printed circuit board 11 to the radiating unit 120A and radiating unit 120B respectively, and passing the RF signals received by the radiating unit 120A and the radiating unit 120B to the circuits on the printed circuit board 11.

The connecting unit 124 comprises a connecting portion 126 and a connecting portion 128. Two ends of the connecting portion 126 are coupled to the radiating unit 120A and 120B respectively, wherein one end comprises a blocking portion F3 and the other end comprises a blocking portion F4. Two ends of the connecting portion 128 are also coupled to the radiating unit 120A and 120B, wherein one end comprises a blocking portion F5 and the other end comprises a blocking portion F6. The connecting portion 126, the connecting portion 128, the radiating unit 120A and the radiating unit 120B form a loop structure. The connecting portion 126 and the connecting portion 128 are parallel and apart by at least a distance H equal to the height of the printed circuit board 11, making the loop structure capable of covering one side of the printed circuit board 11 in a tolerable range of manufacturing errors.

The fixing unit 130 is coupled to the connecting portion 126, and is in the same plane with the connecting portion 126. The fixing unit 132 is coupled to the connecting portion 128, and is in the same plane with the connecting portion 128. Please note that the embedded antenna 12 is a planner inverted-F antenna (PIFA), therefore, at least one of the fixing unit 130 and the fixing unit 132 must be coupled to the ground plane of the printed circuit board 11. The blocking unit 134 and the blocking unit 136 are both coupled between the connecting portion 126 and the connecting portion 128, and are utilized for positioning. The plane of the blocking unit 134 and the blocking unit 136 is perpendicular to the plane of the connecting portion 126 or the connecting portion 128. When the embedded antenna 112 covers one side of the printed circuit board 11, due to the existence of the blocking unit 130 and the blocking unit 132, the printed circuit board 11 is unlikely to deviate from a predetermined position; thereof, the feeding unit 122A and the feeding unit 122B are capable of connecting with the metal area A and the metal area B of the printed circuit board 11 in a precise location, respectively. Also, the fixing unit 130 and the fixing unit 132 can also connect with the metal area C and the metal area D of the printed circuit board 11 in a precise location, respectively. At least one of the metal area C and the metal area D is coupled to the ground plane of the printed circuit board 11.

Moreover, the blocking portions F1 and F2 of the feeding units 122A and 122B, and the blocking portions F3, F4, F5, and F6 of the connecting portions 126 and 128 are also utilized for positioning, to keep the radiating unit 120A and 120B apart from the printed circuit board 11 by a distance G, for avoiding the interference caused from the noise of the periphery ground plane of the printed circuit board 11 to affect the RF signals transmitted by the radiating unit 120A and 120B. Please note here, the objectives of the blocking portions F1-F6 are used to keep the printed circuit board 11 a distance apart from the radiating units 120A and 120B. In another example, the above blocking units are coupled to the connecting portions, for aligning the at least one feeding unit with at least one metal area of the printed circuit board when the embedded antenna covers one side of the printed circuit board. Physical forms of the blocking portions F1-F6 are not limited in the present invention; that is, it can be fillisters as illustrated in FIG. 1 or dimples also formed in the manufacture process of the embedded antenna 12, in other embodiments of the present invention.

Therefore, the loop structure, formed by the connecting unit 124, the radiating unit 120A, and the radiating unit 120B, together with the blocking unit 134 and the blocking unit 136, constitute a cap-like structure, making the embedded antenna 12 capable of covering one side of the printed circuit board 11. After performing the solder paste printing process of the surface mount technology procedure on the printed circuit board 11, the embedded antenna 12 is mounted on the printed circuit board 11 by an assembling step. Next, the automatic component placement procedure is performed on the printed circuit board 11 with the embedded antenna 12. Last, the embedded antenna 12 and the printed circuit board 11 pass the reflow process together. As a result, the feeding unit 122A and the feeding unit 122B are fixed and electrically connected onto the metal area A and the metal area B of the printed circuit board 11 respectively, and the fixing unit 130 and the fixing unit 132 are also fixed to the metal area C and the metal area D respectively. In other words, the embedded antenna 12 is fixed onto the printed circuit board 11 through the surface mount technology procedure.

In brief, according to the design of the embedded antenna 12 in FIG. 1, only one step needs to be added to the assembling process of the communication device 10, i.e. making the embedded antenna 12 covering one side of the printed circuit board 11 before the automatic component placement procedure, and it resembles assembling two antennas at the same time. The prior art embedded antenna compatible of the 2T2R communication device must be manually welded twice; by contrast, the assembling process of the embedded antenna 12 of the communication device 10 is simpler. In the meanwhile, it decreases the possible errors caused by manual welding, and excessively enhances the yield rate. In addition, it can be shown in FIG. 1 that the embedded antenna 12 combines, as a cap, with the printed circuit board 11, so that the radiating unit 120A and the radiating unit 120B of the embedded antenna 12 are located in the both sides of the printed circuit board 11. Therefore, the height of the communication device 10 is mainly determined based on the embedded antenna 12. For example, if the height of the embedded antenna 12 is 4 millimeters and the height of the printed circuit board 11 is 2 millimeters, the total height of the communication device 10, shells not included, would be 4 millimeters, wherein the height of the printed circuit board 11 is overlapped and absorbed by the height of the embedded antenna 12 and is hence involved. Under the same conditions, the total height of the prior art communication device is the height of the printed circuit board plus the height of the embedded antenna, which equals 6 millimeters. By contrast, the embodiment according to the present invention minimizes the height of the communication device, which is an advantage for appearance of communication device.

In addition, it can be shown in FIG. 3 that the embedded antenna 12 can be manufactured in a monolithic way. All units of embedded antenna 12 are in fact formed by a single integrated bent metal plate. As a result of the monolithic antenna, the connecting portion 128 is further divided into 128L and 128R; the fixing unit 132 is also divided into 132L and 132R, which are all electrically connected to the metal area C of the printed circuit board 11 through the surface mount technology procedure. Please note that the communication device 10 is merely an embodiment according to the present invention, and can be varied and modified accordingly by those skilled in the art. The monolithic embedded antenna 12 illustrated in FIG. 3 is merely one realization of the antenna 12 for simplifying the production process, and the present invention is not limited to it. The embedded antenna 12 can also be formed by assembling a plurality of metal plates. In the embodiments according to the present invention, the forms, the numbers, and the locations of radiating units, fixing units, blocking units and fillister blocking portions of embedded antenna 12 can all be designed and modified to fit the system requirements.

Figure 4:
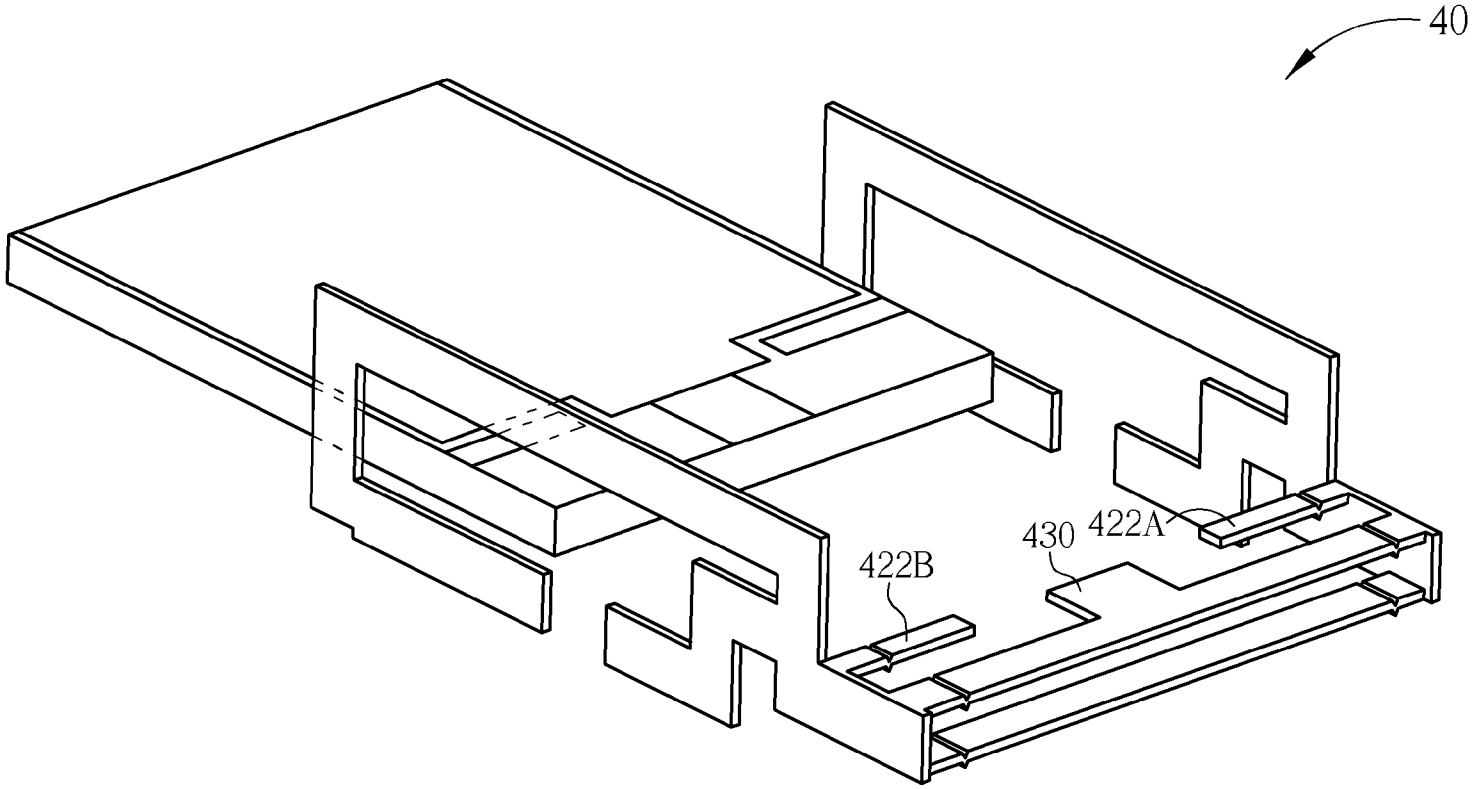
FIG. 4 is a schematic diagram of a communication device according to an embodiment of the present invention.

Please refer to FIG. 4 to FIG. 7, which are schematic diagrams of communication devices 40, 50, 60, and 70 according to embodiments of the present invention. Each communication device is a variation embodiment of the communication device 10 of FIG. 1, and is also formed by assembling a printed circuit board and an embedded antenna. The functionalities and connecting relations of units of the communication devices 40, 50, 60 and 70 can be derived based on FIG. 1 and the above descriptions, and are not detailed narrated herein. Hereinafter, only the differences will be depicted. In FIG. 4, the embedded antenna of the communication device 40 does not include a blocking unit. Before performing the automatic component placement procedure of the surface mount technology procedure to the printed circuit board, a fixture can be used to replace the blocking unit, making the embedded antenna cover the printed circuit board and a feeding unit 422A, a feeding unit 422B, and a fixing unit 430 of the embedded antenna can connect with the corresponding metal areas of the printed circuit board in precise positions. Therefore, the surface mount technology procedure can be performed to assemble the embedded antenna on the printed circuit board without an additional manual welding step. Moreover, there is only one fixing unit of the embedded antenna of the communication device 40, since the feeding unit 422A and the feeding unit 422B are not only the feeding point of signals, but also providers of the fixed function, i.e. they connect with the printed circuit board by solder paste.

Figure 5:
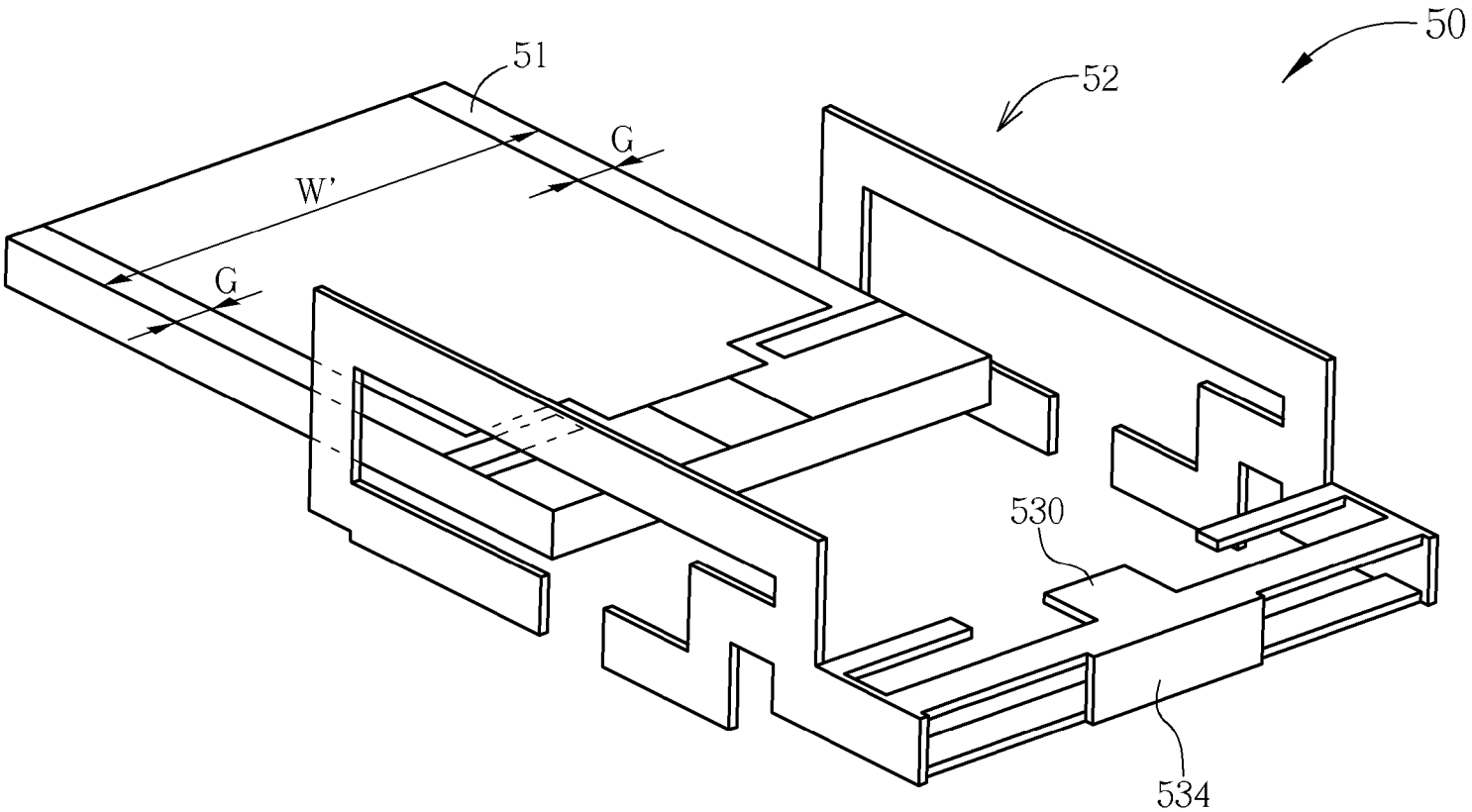
FIG. 5 is a schematic diagram of a communication device according to an embodiment of the present invention.
Figure 6:
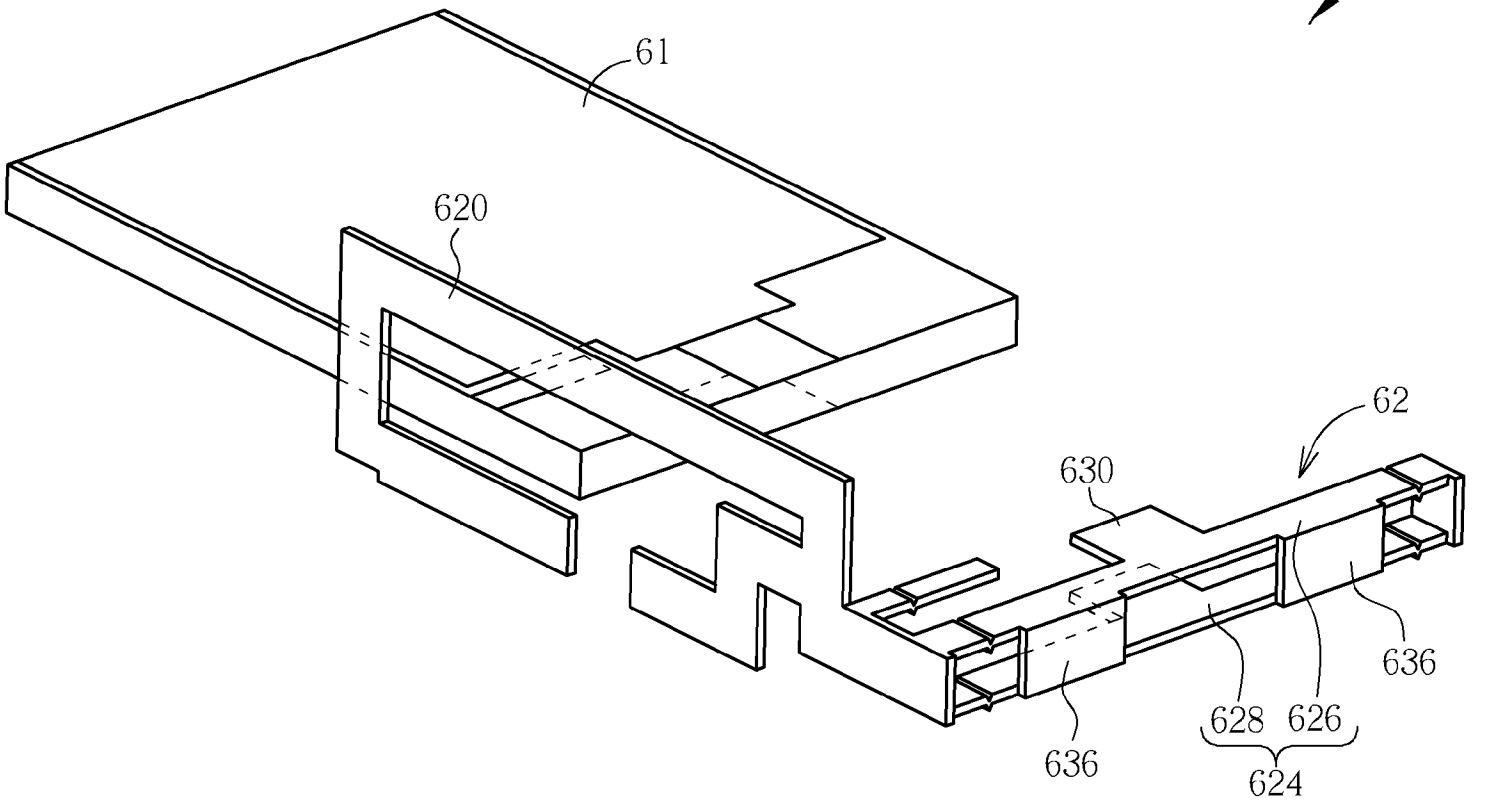
FIG. 6 is a schematic diagram of a communication device according to an embodiment of the present invention.
Figure 7:
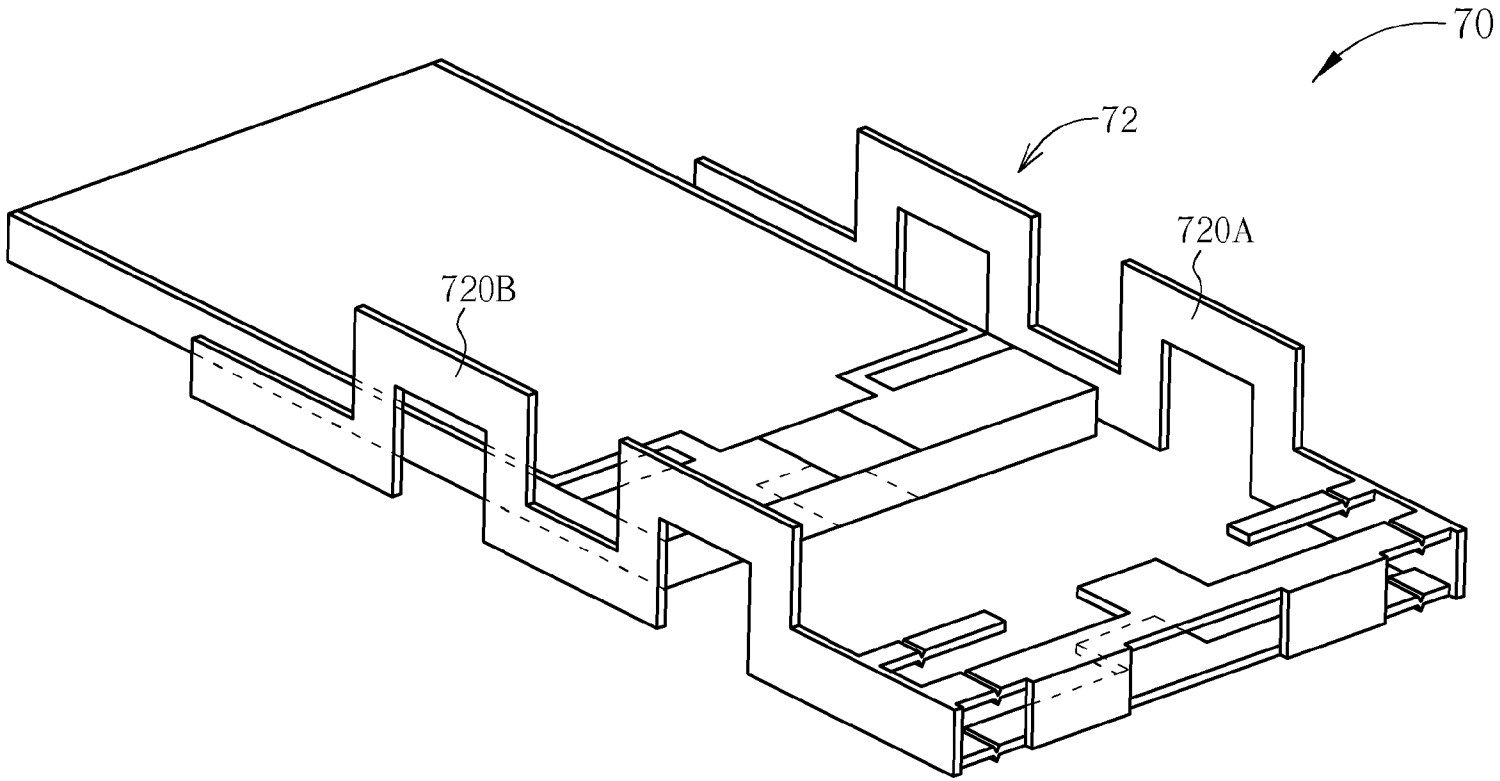
FIG. 7 is a schematic diagram of a communication device according to an embodiment of the present invention.

In FIG. 5, a printed circuit board 51 of the communication device 50 is different from the printed circuit board 11 of the communication device 10. The ground plane of the printed circuit board 51 is a predetermined distance apart from both sides of the printed circuit board 51, equals the distance G in FIG. 1; the width of the printed circuit board 51, W', is larger than the width of the printed circuit board 11, W. In other words, there is a clearance area around the sides of the printed circuit board 51. An embedded antenna 52 of the communication device 50 comprises merely one fixing unit and one blocking unit, such as a fixing unit 530 and a blocking unit 534 in FIG. 5. No fillister blocking portion is set on the feeding unit and the connecting portion because the distance G, by which the ground plane of the printed circuit board 51 is apart from the sides of the printed circuit board 51, is long enough to avoid the interference caused from the noise on the ground plane to affect the RF signals transmitted by the radiating units of the embedded antenna, and hence no fillister blocking portion is needed to keep the printed circuit board 51 and the radiating units of the embedded antenna apart. In addition, by adequately designing the size and location of the blocking unit 534, even the embedded antenna 52 comprises only one blocking unit, the functionality of positioning the printed circuit board 51 can also be fulfilled.

In the above embodiments, the embedded antennas take the antennas compatible in the 2T2R system as examples, whereas in practice, the number of antenna of present invention is not limited to specific one; it can be only one or upward two. For example, in FIG. 6, an embedded antenna 62 is a single planar inverted-F antenna. In spite that the embedded antenna 62 comprises merely a radiating unit 620, a connecting portion 626 and a connecting portion 628 of a connecting unit 624 of the embedded antenna 62 together with a radiating unit 620 still form a loop structure, and further form a cap-like structure with blocking units 634 and 636. Therefore, the embedded antenna 62 is capable of covering one side of a printed circuit board 61 of the communication device 60, and then the automatic component placement procedure and the reflow procedure of the surface mount technology procedure are performed on the printed circuit board 61 with the embedded antenna 62. Those skilled in the art can make alternations and modifications to the embedded antenna 62 according to the above embodiment, such as reducing the number of fixing unit or blocking unit to one, or altering the design of the ground plane of printed circuit board and canceling the fillister blocking portions, and is not narrated herein.

Please note that the embedded antennas in FIG. 1 to FIG. 6 take planar inverted-F antenna antennas as examples, however, the embedded antenna of the embodiment according to the present invention is not limited to the planar inverted-F antenna, monopole antenna, or antenna of other types are also included. For example, in FIG. 7, an embedded antenna 72 of the communication device 70 is the combination of two monopole antennas, and the form of radiating units 720A and 720B of the embedded antenna 72 is different from the form of the radiating units 120A and 120B in FIG. 1. In addition, since the embedded antenna 72 is the combination of monopole antennas, fixing units of the embedded antenna 72 need not to connect to the ground plane of printed circuit board. Those skilled in the art can make alternations and modifications to the embedded antenna 72 according to the above embodiment, and is not narrated herein.

To sum up, in the communication devices of embodiments according to the present invention, the printed circuit boards are designed corresponding to the embedded antenna, hence, only one step needs to be added to the assembling process of the communication device, i.e. making the embedded antenna cover one side of the printed circuit board before the automatic component placement procedure, so that the automatic component placement procedure and the reflow procedure are performed on the printed circuit board with the embedded antenna. Therefore, the high assembling cost and the instability of antenna characteristics owing to the manual welding process in the assembling process of the prior art communication device can be avoided. In addition, the embedded antennas of embodiments according to the present invention not only are easier to assemble, but also enable overlaps in the space occupied by the embedded antennas and the printed circuit boards to get minimized heights of the communication devices.

Those skilled in the art will readily observe that numerous modifications and alterations of the device and method may be made while retaining the teachings of the invention.

What is claimed is:

1. A communication device with an embedded antenna comprising:

a printed circuit board; and an embedded antenna, comprising:

at least one radiating unit;

at least one feeding unit, wherein each feeding unit is coupled to one of the at least one radiating unit and the printed circuit board; and a connecting unit, coupled to the at least one radiating unit, comprising a first connecting portion and a second connecting portion, wherein the connecting unit and the at least one radiating unit form a loop structure such that the embedded antenna covers one side of the printed circuit board.

2. The communication device of claim 1, wherein the at least one feeding unit is electrically connected to a metal area of the printed circuit board by a surface mount technology procedure.

3. The communication device of claim 1, wherein the embedded antenna further comprises at least one fixing unit coupled to the connecting unit, for electrically connecting the embedded antenna and at least one metal area of the printed circuit board.

4. The communication device of claim 3, wherein one of the at least one fixing unit is coupled to a ground plane of the printed circuit board.

5. The communication device of claim 1, wherein the embedded antenna further comprises at least one blocking unit coupled to the connecting unit, for aligning the at least one feeding unit with at least one metal area of the printed circuit board when the embedded antenna covers one side of the printed circuit board.

6. The communication device of claim 1, wherein the at least one radiating unit and the printed circuit board are a predetermined distance apart.

7. The communication device of claim 6, wherein each of the at least one feeding unit comprises a blocking portion, for maintaining the predetermined distance between the printed circuit board and each of the at least one radiating unit.

8. The communication device of claim 6, wherein each of the both sides of the first connecting portion and the second connecting portion comprises a blocking portion, for maintaining the predetermined distance between the printed circuit board and each of the at least one radiating unit.

9. The communication device of claim 1, wherein the embedded antenna is formed by at least one metal plate.

10. The communication device of claim 1, wherein the embedded antenna is a planar inverted-F antenna.

11. The communication device of claim 1, wherein the embedded antenna is a monopole antenna.

* * * * *